US007866304B2

(12) United States Patent
Riedel et al.

(10) Patent No.: US 7,866,304 B2
(45) Date of Patent: Jan. 11, 2011

(54) ENGINE FUEL BOIL OFF MANAGEMENT SYSTEM

(75) Inventors: Paulo A. Riedel, Rochester Hills, MI (US); Thomas A. Spix, Rochester Hills, MI (US); Leandro D. Nadai, Novi, MI (US); Claudio Engler Pinto, Indaiatuba (BR)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 12/431,984

(22) Filed: Apr. 29, 2009

(65) Prior Publication Data

US 2010/0275886 A1 Nov. 4, 2010

(51) Int. Cl.
*F02M 15/00* (2006.01)
*F02B 25/06* (2006.01)

(52) U.S. Cl. ..... 123/540; 123/573

(58) Field of Classification Search ..... 123/516, 123/518, 540, 543, 572, 573
See application file for complete search history.

(56) References Cited

U.S. PATENT DOCUMENTS 3,799,125 A * 3/1974 Hutchinson ..... 123/3
4,269,607 A * 5/1981 Walker ..... 95/271
4,557,226 A * 12/1985 Mayer et al. ..... 123/41.86
4,945,887 A * 8/1990 Sakurai et al. ..... 123/573
4,962,745 A * 10/1990 Ohno et al. ..... 123/533
5,329,913 A * 7/1994 Suzuki et al. ..... 123/573
5,450,835 A * 9/1995 Wagner ..... 123/573
5,456,239 A * 10/1995 Henderson et al. ..... 123/563
5,579,744 A * 12/1996 Trefz ..... 123/573
5,937,837 A * 8/1999 Shaffer et al. ..... 123/573
6,058,917 A * 5/2000 Knowles ..... 123/573
6,186,128 B1 * 2/2001 Diotte et al. ..... 123/572
6,412,479 B1 * 7/2002 Canfield et al. ..... 123/573
6,494,192 B1 * 12/2002 Capshaw et al. ..... 123/576
6,691,687 B1 * 2/2004 Liang et al. ..... 123/572
6,729,316 B1 * 5/2004 Knowles ..... 123/572
6,994,078 B2 * 2/2006 Roberts et al. ..... 123/572
7,100,587 B2 * 9/2006 Ahlborn et al. ..... 123/572
7,370,610 B2 * 5/2008 Ashford et al. ..... 123/3
7,422,612 B2 * 9/2008 Pietschner ..... 55/309
7,588,020 B2 * 9/2009 Yasuhara ..... 123/572
2010/0089345 A1 * 4/2010 Kim et al. ..... 123/41.86

* cited by examiner

*Primary Examiner*—Thomas N Moulis
(74) *Attorney, Agent, or Firm*—Harness, Dickey & Pierce, P.L.C.

(57) ABSTRACT

An engine assembly may include a crankcase ventilation assembly having a fuel separator assembly. The fuel separator assembly may include a condensing unit and a vaporizing unit. The condensing unit may include a gas region and a liquid retaining region. A gas inlet may be in fluid communication with the gas region and a gas flow from the engine block including fuel vapor. The condensing unit may convert the fuel vapor to liquid fuel. The first gas outlet may be in fluid communication with an engine air inlet and provide a remainder of the gas flow thereto. The fluid region may store and provide the liquid fuel to the vaporizing unit through a liquid inlet. The vaporizing unit may convert the liquid fuel to fuel vapor and a second gas outlet may provide the fuel vapor to the air inlet.

20 Claims, 1 Drawing Sheet

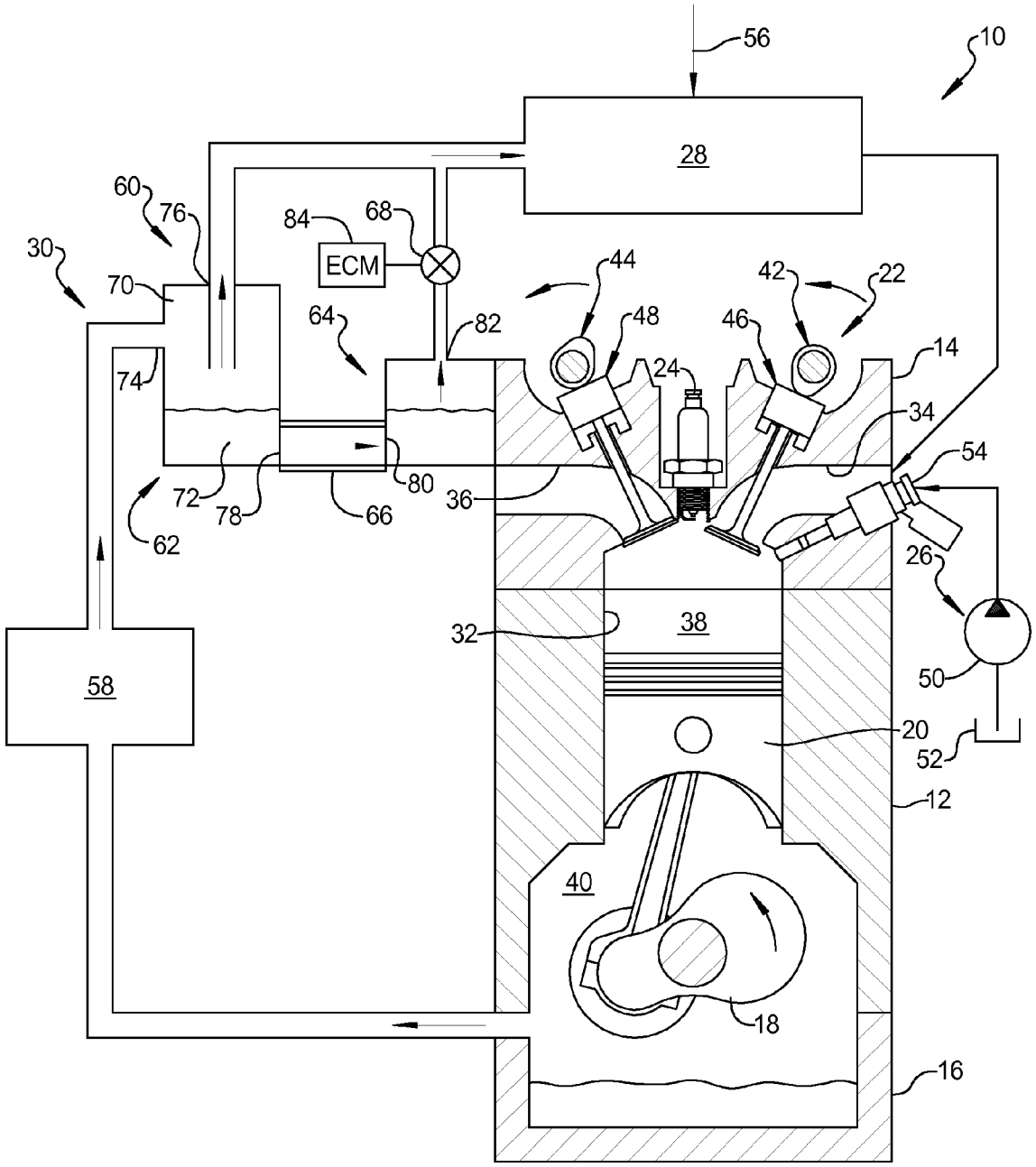
FIGURE

ENGINE FUEL BOIL OFF MANAGEMENT SYSTEM

FIELD

The present disclosure relates to engine fuel management.

BACKGROUND

This section provides background information related to the present disclosure which is not necessarily prior art.

During engine operation, fuel may migrate from the combustion chamber to the crankcase and eventually into the engine oil resulting in oil dilution. The fuel may transform to fuel vapor as the engine warms up. The fuel vapor may be transported with other crankcase gases to the intake manifold back to the combustion chamber for a subsequent combustion event via the crankcase ventilation system. This process may result in unregulated introduction of fuel vapor into the combustion chamber.

SUMMARY

This section provides a general summary of the disclosure, and is not comprehensive of its full scope or all of its features.

An engine assembly may include an engine block defining a cylinder bore having a piston disposed therein, a cylinder head coupled to the engine block and defining an air inlet in fluid communication with the cylinder bore, and a crankcase ventilation assembly in fluid communication with the engine block and the air inlet. The crankcase ventilation assembly may include a fuel separator assembly having a condensing unit and a vaporizing unit. The condensing unit may include a gas region, a liquid retaining region, a gas inlet, a first gas outlet, and a liquid outlet. The gas inlet may be in fluid communication with the gas region and a gas flow from the engine block including fuel vapor. The condensing unit may convert the fuel vapor to liquid fuel based on a first temperature of the condensing unit. The first gas outlet may be in fluid communication with the air inlet and provide a remainder of the gas flow thereto. The fluid region may store the liquid fuel. The vaporizing unit may include a liquid inlet and a second gas outlet. The liquid inlet may be in fluid communication with the liquid outlet of the condensing unit and may receive the liquid fuel from the condensing unit. The vaporizing unit may convert the liquid fuel to fuel vapor based on a second temperature of the vaporizing unit. The second gas outlet may provide the fuel vapor to the air inlet.

A fuel boil off management method may include receiving a gas flow in a condensing unit of a fuel separation assembly from an engine crankcase and separating a fuel content from the gas flow within the condensing unit. The separating may include converting a fuel vapor within the gas flow to liquid fuel based on a first temperature of the condensing unit and storing the liquid fuel within the condensing unit. A remainder of the gas flow may exit the condensing unit and be provided to an engine air inlet. The liquid fuel may be transferred from the condensing unit to a vaporizing unit. The method may further include converting the liquid fuel within the vaporizing unit to fuel vapor based on a second temperature of the vaporizing unit and providing the fuel vapor to the engine air inlet.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only and are not intended to limit the scope of the present disclosure in any way.

The FIGURE is a schematic illustration of an engine assembly according to the present disclosure.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

An engine assembly 10 is schematically illustrated in the FIGURE and may include an engine block 12, a cylinder head 14, an oil pan 16, a crankshaft 18, pistons 20 (one of which is shown), a valvetrain assembly 22, a spark plug 24, a fuel system 26, an intake manifold 28, and a crankcase ventilation assembly 30. The engine block 12 may define cylinder bores 32 (one of which is shown), each having a piston 20 disposed therein. It is understood that the present teachings apply to any number of piston-cylinder arrangements and a variety of engine configurations including, but not limited to, V-engines, inline engines, and horizontally opposed engines, as well as both overhead cam and cam-in-block configurations. Further, it is understood that the present teachings apply equally to positive crankcase ventilation (PCV) systems and closed crankcase ventilation (CCV) systems.

The cylinder head 14 may include intake and exhaust passages 34, 36. The engine block 12, cylinder head 14, and piston 20 may cooperate to define a combustion chamber 38. The intake passage 34 may form an air inlet into the combustion chamber 38 and the exhaust passage 36 may form an exhaust gas outlet from the combustion chamber 38. The spark plug 24 may be located in the cylinder head 14 and extend into the combustion chamber 38. The oil pan 16 may be coupled to the engine block 12 and may retain oil within the engine assembly 10. The engine block 12 and the oil pan 16 may cooperate to define an engine crankcase 40.

The valvetrain assembly 22 may be supported by the cylinder head 14 and may include intake and exhaust camshafts 42, 44 and intake and exhaust valve assemblies 46, 48. The intake camshaft 42 may be engaged with the intake valve assembly 46 and the exhaust camshaft 44 may be engaged with the exhaust valve assembly 48.

The fuel system 26 may include a fuel pump 50 in communication with a fuel supply 52, such as a fuel tank, and a fuel injector 54. The fuel injector 54 may be in fluid communication with the combustion chamber 38. In the present non-limiting example, the fuel injector 54 may be located in the cylinder head 14, extending into the combustion chamber 38, forming a direct injection configuration. However, it is understood that the present disclosure is in no way limited to direct injection applications. The present teachings may be used in a variety of other fuel injection applications including port injection configurations.

The intake manifold 28 may be in fluid communication with a fresh air supply 56, the crankcase ventilation assembly 30, and the intake passage 34 in the cylinder head 14. The crankcase ventilation assembly 30 may include an oil separation assembly 58 and a fuel separation assembly 60. The oil separation assembly 58 may be in fluid communication with the engine crankcase 40 and the intake manifold 28. More specifically, the oil separation assembly 58 may receive a crankcase gas flow from the crankcase 40. As the crankcase gas passes through the oil separation assembly 58, oil entrained in the gas may be separated from the gas and the remainder of the gas flow may continue toward the intake manifold 28. While the oil separation assembly 58 is illustrated between the crankcase 40 and the fuel separation assembly 60, it is understood that the oil separation assembly 58 may alternatively be located between the fuel separation assembly 60 and the intake manifold 28.

The fuel separation assembly 60 may include a condensing unit 62, a vaporizing unit 64, a passageway 66 extending between the condensing and vaporizing units 62, 64, and a valve 68. The condensing unit 62 may form a container including a gas region 70, a liquid region 72, a gas inlet 74, a first gas outlet 76 and a liquid outlet 78. The gas inlet 74 may be in fluid communication with the gas region 70 and the crankcase 40 and may receive a crankcase gas flow from the crankcase 40. In the present non-limiting example, the gas inlet 74 may receive the crankcase gas flow exiting the oil separation assembly 58. The first gas outlet 76 may be in fluid communication with the gas region 70 and the intake manifold 28 and may extend a distance into the condensing unit 62 to aide in fuel separation, as discussed below. The liquid outlet 78 may be in fluid communication with the liquid region 72 of the condensing unit 62 and the vaporizing unit 64 via the passageway 66.

The condensing unit 62 may be isolated from heat generating components of the engine assembly 10. The condensing unit 62 may be formed from a thermally conductive material such as a thermally conductive metal and may be exposed to an ambient air temperature, as discussed below. The passageway 66 may be constructed of an insulating material to limit heat transfer between the vaporizing unit 64 and the condensing unit 62. A variety of thermally insulating materials may be used including plastics and elastomers.

The vaporizing unit 64 may include a liquid inlet 80 and a second gas outlet 82. The liquid inlet 80 may be in fluid communication with the liquid region 72 of the condensing unit 62 via the passageway 66. The second gas outlet 82 may be in fluid communication with the intake manifold 28. The valve 68 may be located between and may be in fluid communication with both the second gas outlet 82 of the vaporizing unit 64 and the intake manifold 28 to selectively provide fluid communication therebetween. The vaporizing unit 64 may be located in a heat transfer relation to a heat generating component of the engine assembly 10. More specifically, the vaporizing unit 64 may abut a heat generating component of the engine assembly 10. In the present non-limiting example, the heat generating engine component may include the cylinder head 14. However, it is understood that a variety of other heat generating components may be used including, but not limited to, the engine block 12, a radiator (not shown), or an electrical heater (not shown). The vaporizing unit 64 may be formed from a thermally conductive material such as a thermally conductive metal.

During engine operation, fuel is provided to and combusted within the combustion chamber 38. A portion of the fuel may impact a cylinder wall defining the combustion chamber 38 and may migrate to the engine crankcase 40. The fuel migrating to the crankcase 40 may accumulate in the oil pan 16. The engine crankcase 40 (and oil/fuel mixture therein) may reach an operating temperature where the fuel boils and turns to a fuel vapor. The fuel vapor may then mix with the crankcase gases. The crankcase gases may ultimately travel to the intake manifold 28, and therefore the intake passage 34, via the crankcase ventilation assembly 30. The fuel separation assembly 60 may control an amount of fuel vapor introduced to the intake passage 34.

Specifically, the crankcase gas flow may enter the condensing unit 62. The crankcase gas flow may experience a temperature drop when it enters the condensing unit 62, resulting in condensation of fuel vapor from the crankcase gas. The condensing unit may be operated at a first temperature to transform the fuel vapor to a liquid state. The first temperature may be less than sixty degrees Celsius. As indicated above, the condensing unit 62 may be generally isolated from heat generating engine components. The condensing unit may be exposed to an ambient air temperature, such as a vehicle underhood air temperature. However, while illustrated as being cooled by ambient air conditions, it is understood that cooling devices (not shown) may alternatively and/or additionally be used to control an operating temperature of the condensing unit 62.

In the present non-limiting example, the crankcase gas flow may impact the walls of the condensing unit 62 to enhance the cooling of the fuel vapor. The liquid fuel created by the condensation of the fuel vapor may fall to and be stored in the liquid region 72 of the condensing unit 62. The remaining crankcase gas flow may exit the condensing unit 62 via the first gas outlet 76 and proceed to the intake manifold 28, and ultimately the intake passage 34. The extent of the first gas outlet 76 within the condensing unit 62 may assist in preventing the fuel vapor from exiting the condensing unit 62 in a gaseous state.

The liquid fuel retained within the liquid region 72 of the condensing unit 62 may be provided to the vaporizing unit 64 via the passage 66 and liquid inlet 80. The liquid fuel within the vaporizing unit 64 may be heated to a second temperature to return the liquid fuel to a gaseous state (fuel vapor). The second temperature may include a temperature sufficient to boil the liquid fuel. More specifically, the second temperature may be greater than eighty degrees Celsius. As indicated above, the vaporizing unit 64 may be heated by heat transfer from a heat generating engine component. However, it is understood that heating devices (not shown) other than engine components may alternatively and/or additionally be used to control an operating temperature of the vaporizing unit 64. The fuel vapor generated in the vaporizing unit 64 may be provided to the intake manifold 28 via the second gas outlet 82, and ultimately to the intake passage 34.

The amount of fuel vapor exiting the vaporizing unit 64 may be controlled by the valve 68. By way of non-limiting example, the valve 68 may include a pulse-width-modulation (PWM) controlled solenoid valve in electrical communication with a control module, such as an engine control module 84.

What is claimed is:

1. An engine assembly comprising:

an engine block defining a cylinder bore having a piston disposed therein;

a cylinder head coupled to the engine block and defining an air inlet in fluid communication with the cylinder bore; and a crankcase ventilation assembly in fluid communication with the engine block and the air inlet, the crankcase ventilation assembly including fuel separator assembly having:

a condensing unit including a gas region, a liquid retaining region, a gas inlet, a first gas outlet, and a liquid outlet, the gas inlet in fluid communication with the gas region and a gas flow from the engine block including fuel vapor, the condensing unit converting the fuel vapor to liquid fuel based on a first temperature of the condensing unit, the first gas outlet being in fluid communication with the air inlet and providing a remainder of the gas flow thereto, and the fluid region storing the liquid fuel; and a vaporizing unit including a liquid inlet and a second gas outlet, the liquid inlet being in fluid communication with the liquid outlet of the condensing unit and receiving the liquid fuel from the condensing unit, the vaporizing unit converting the liquid fuel to fuel vapor based on a second temperature of the vaporizing unit, the second gas outlet providing the fuel vapor to the air inlet.

2. The engine assembly of claim 1, wherein the fuel separator assembly includes a valve in fluid communication with the air inlet and the second gas outlet and selectively providing fluid communication therebetween.

3. The engine assembly of claim 1, wherein the fuel separator assembly includes a conduit extending between and providing fluid communication between the liquid outlet of the condensing unit and the liquid inlet of the vaporizing unit, the conduit thermally insulating the condensing and vaporizing units from one another.

4. The engine assembly of claim 1, wherein the vaporizing unit is in a heat exchange relation with a heat generating engine component, the engine component heating the vaporizing unit to the second temperature.

5. The engine assembly of claim 4, wherein the engine component includes the cylinder head.

6. The engine assembly of claim 4, wherein the condensing unit is isolated from the heat generating engine component.

7. The engine assembly of claim 6, wherein the first temperature is generally an ambient air temperature.

8. The engine assembly of claim 1, wherein the crankcase ventilation assembly includes an oil separation mechanism in fluid communication with the gas flow from the engine block, the oil separation mechanism removing oil entrained in the gas flow.

9. The engine assembly of claim 8, wherein the gas flow travels through the oil separation mechanism before the fuel separator assembly.

10. A crankcase ventilation assembly comprising:

a fuel separator assembly in fluid communication with an engine block and an air inlet to an engine combustion chamber, the fuel separator assembly including:

a condensing unit including a gas region, a liquid retaining region, a gas inlet, a first gas outlet, and a liquid outlet, the gas inlet in fluid communication with the gas region and a gas flow from the engine block including fuel vapor, the condensing unit converting the fuel vapor to liquid fuel based on a first temperature of the condensing unit, the first gas outlet being in fluid communication with the air inlet and providing a remainder of the gas flow thereto, and the fluid region storing the liquid fuel; and a vaporizing unit including a liquid inlet and a second gas outlet, the liquid inlet being in fluid communication with the liquid outlet of the condensing unit and receiving the liquid fuel from the condensing unit, the vaporizing unit converting the liquid fuel to fuel vapor based on a second temperature of the vaporizing unit, the second gas outlet providing the fuel vapor to the air inlet.

11. The crankcase ventilation assembly of claim 10, wherein the fuel separator assembly includes a valve in fluid communication with the air inlet and the second gas outlet and selectively providing fluid communication therebetween.

12. The crankcase ventilation assembly of claim 10, wherein the fuel separator assembly includes a conduit extending between and providing fluid communication between the liquid outlet of the condensing unit and the liquid inlet of the vaporizing unit, the conduit thermally insulating the condensing and vaporizing units from one another.

13. The crankcase ventilation assembly of claim 10, wherein the vaporizing unit is in a heat exchange relation with a heat generating engine component, the engine component heating the vaporizing unit to the second temperature.

14. The crankcase ventilation assembly of claim 13, wherein the condensing unit is isolated from the heat generating engine component.

15. The crankcase ventilation assembly of claim 10, further comprising an oil separation mechanism in fluid communication with the gas flow from the engine block, the oil separation mechanism removing oil entrained in the gas flow.

16. A method comprising:

receiving a gas flow in a condensing unit of a fuel separation assembly from an engine crankcase;

separating a fuel content from the gas flow within the condensing unit, the separating including converting a fuel vapor within the gas flow to liquid fuel based on a first temperature of the condensing unit and storing the liquid fuel within the condensing unit, a remainder of the gas flow exiting the condensing unit and being provided to an engine air inlet;

transferring the liquid fuel from the condensing unit to a vaporizing unit;

converting the liquid fuel within the vaporizing unit to fuel vapor based on a second temperature of the vaporizing unit; and providing the fuel vapor to the engine air inlet after the converting.

17. The method of claim 16, wherein the providing the fuel vapor to the engine air inlet includes providing a controlled fuel vapor flow using a valve.

18. The method of claim 16, wherein the condensing unit is thermally insulated from the vaporizing unit by a conduit extending therebetween, the conduit providing fluid communication between the liquid fuel stored in the condensing unit and the vaporizing unit.

19. The method of claim 16, further comprising heating the vaporizing unit to the second temperature by heat transfer from a heat generating engine component.

20. The method of claim 19, wherein the condensing unit is isolated from the heat generating engine component.

* * * * *